US005094049A

United States Patent [19]

Sells

[11] Patent Number: 5,094,049

[45] Date of Patent: Mar. 10, 1992

[54] BLISTER VENT

[76] Inventor: Gary L. Sells, 16250 Petro Dr., Mishawaka, Ind. 46544

[21] Appl. No.: 621,633

[22] Filed: Nov. 30, 1990

[51] Int. Cl.[5] ..... E04B 7/00

[52] U.S. Cl. ..... 52/199; 52/303; 137/197

[58] Field of Search ..... 52/199, 302, 303, 410, 52/411; 137/197, 199

[56] References Cited

U.S. PATENT DOCUMENTS 4,757,654 7/1988 Korhonen et al. ..... 52/199

*Primary Examiner*—David A. Scherbel
*Assistant Examiner*—Wynn Wood
*Attorney, Agent, or Firm*—James D. Hall

[57] ABSTRACT

An improved blister vent for relieving pressure within a blister on a multi-layered roof, wherein the shaft extending downwardly therefrom is provided with laterally extending threads, the pitch of which approximates the thickness of each of the layers of the roofing material.

2 Claims, 2 Drawing Sheets

BLISTER VENT

This invention relates to an improved device for venting trapped gases and relieving pressure from a blister in a multi-layered roof or porch surface.

BACKGROUND AND SUMMARY OF THE INVENTION

In the covering of a flat roof surface, such a covering most commonly consists of a multiplicity of asphalt-impregnated felt or felt-like materials which are manufactured and sold in rolls of various widths and deposited on the roof in layers over an insulation layer.

Customarily, rolls of material are laid out in overlapping configuration. The layers of material, which may include waterproof and moisture resistent layers, are usually covered with a final layer of hot tar.

Blisters are an inevitable "product" of the application of roof surfaces. Gases or vapors, or both, are either entrapped between the various layers or are produced by a reaction of the various products, perhaps further induced by the heat of the sun on the roof.

It is known that internal pressures build up during the heat of the day and subside during the cool of the night. This creates an inevitable expansion and contraction, eventually resulting in the blistering. Such action is exacerbated by the heat of a midsummer sun or the chilling cold of winter.

Once a blister is formed, it will only grow with time until it eventually fractures. Once fractured, water will enter and, not only destroy the layered materials, but also result in leakage into the building.

For many years, and predominantly even now, the primary solution to the problem was an on-site inspection of the roof. If one or more blisters were discovered in a roof, those who maintained the roof had two choices. They would either monitor the blister and repair it when it eventually ruptured, or they could slit and fill and cover the blister with another layer and with tar.

Two problems are encountered. If maintenance is postponed, severe damage usually results when the blister fractures. If the blister is slit and repaired, there is no assurance that the blister will not reappear at or near the same spot.

Fairly recently, engineers employed by the Department of the Army have developed and patented a unique pressure relief valve which is used to solve the blister problem. This valve is the subject of U.S. Pat. No. 4,757,654. The problem and the solution are explained in detail in that patent, of which this Applicant is the exclusive licensee.

Briefly, the solution is a very tiny one-way valve, enclosed in a relatively flat housing having an elongated, relatively sharp, hollow shaft protruding downwardly therefrom and vented via a channel through the valve to the outside of the valve housing. This permits venting of gases or moisture and prevents the inward flow of water.

When a blister is found, the user inserts the valve housing directly into the blister. Alternative designs are disclosed.

Experimental use with the aforesaid device has disclosed that there are certain deficiencies in the structure. In actual operation, the smooth shafted devices have a tendency to pop out, and there is a tendency to separate the layers of roofing material when the threaded devices are inserted.

Further the multi-sectional housing, with its O-ring and chambers is extremely complicated in assembly and operation.

It is accordingly an object of this invention to create a blister vent which is much simpler in structure and of an improved design which overcomes the deficiencies mentioned above.

BRIEF DESCRIPTION OF THE DRAWINGS

The present invention is illustrated hereinafter by a detailed description of the preferred embodiment, which is presented in conjunction with, and by reference to, the accompanying drawings, in which like reference characters refer to like or corresponding parts, and wherein.

DETAILED DESCRIPTION OF THE PREFERRED EMBODIMENT

Figure 2:
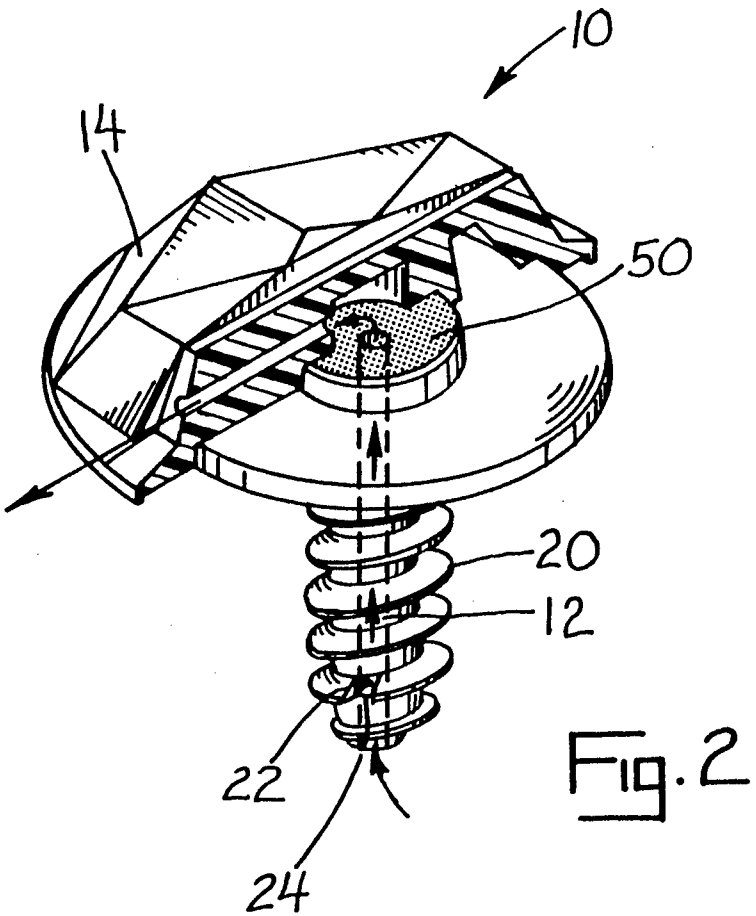
FIG. 2 is a perspective sectional view of the vent cut away to illustrate the membrane valve and the passageway for escaping air.
Figure 1:
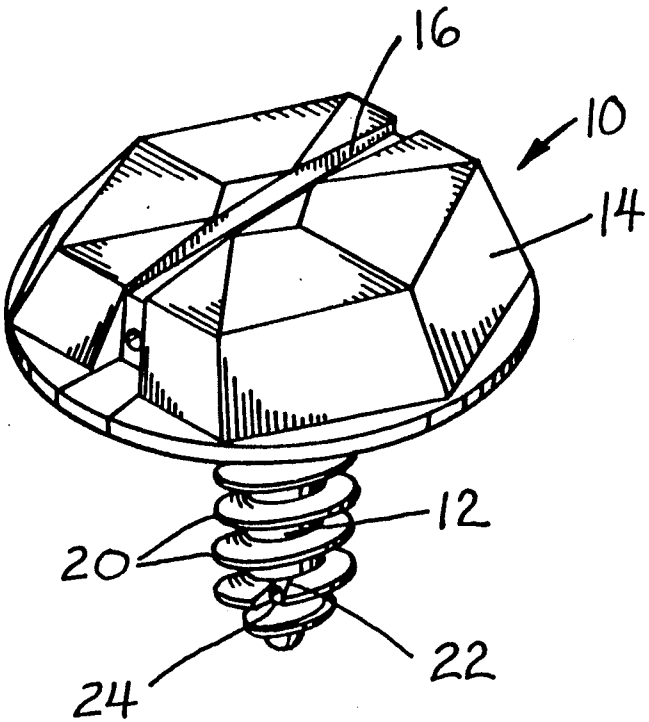
FIG. 1 is a perspective view of the vent of this invention.
Figure 3:
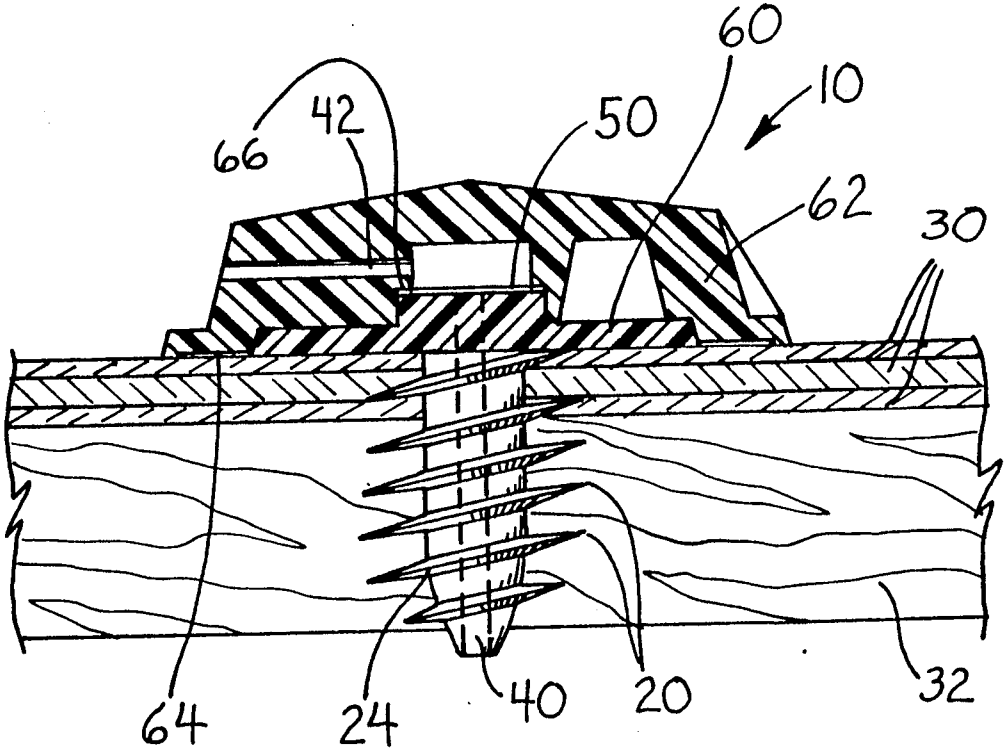
FIG. 3 is a sectional view of the vent of this invention inserted into layers of roofing material and further illustrating the placement of the membrane valve and the passageway for escaping air.

The preferred embodiment illustrated is not intended to be exhaustive or to limit the invention to the precise form disclosed. It has been chosen and is herein described in order to best explain the invention and its practical use to enable others skilled in the art to best utilize the invention.

Vent 10 of this invention is in the shape of a hexagonal body 14 imposed upon a circular base. Extending downwardly from the base thereof is a hollow threaded shaft 12. For ease of insertion, the body of vent 10 is provided with slot 16.

Critical to this invention is the size and spacing of threads 20 on shaft 12. As explained above, the previous valve had a tendency to separate the layers of roofing material and to work loose from the insulating layer. Roofing materials are generally of a consistent thickness. Threads 20 of this invention are molded so to generally conform to the thickness of conventional roofing material layers 30. Further, threads 20 of this invention are extremely thin and elongated, almost ribbon-like, so that they grip the insulating material without crumbling it.

This unique shape of threads 20 not only means that there is generally a layer 30 of roofing material between each of threads 20, but also that threads 20 extend a significant distance between layers 30 and into insulating material 32. This provides an unexpectedly secure anchor for vent 10 and ensures that it cannot be accidentally removed.

It will be understood that several threads and several layers of roofing materials are illustrated, but that the length of shaft 12 and the number of threads 20 is variable and a design option.

The prior art device had a rather complex multi-sectional housing, even including a tiny O-ring, which could be opened and closed by the user. This structure could come open in the pocket or carrying case of the user and parts separated and lost.

Through experimentation, it has been found that, if the side vent hole is in one or more of the threads, the hole remains free and does not become clogged.

One or more of threads 20 are provided with a cut-away portion 22, wherein is located a vent hole 24 extending into central bore 40 of shaft 12.

As explained, central bore 40 of shaft 12 extends into body 14 of vent 10. Within a chamber of body 14 is membrane 50, placed so as to intercept bore 40. Membrane 50 is fabricated of a material which is permeable to air and other gases and impermeable to water. Such materials are commercially available and are of a microporous metallic, ceramic or polymeric composition.

The effect of this is that, when installed, the blister vent allows all of the entrapped gases to escape and then continues to relieve the pressures as the gases re-build. While doing so, the membrane prevents any water on the roof from entering the interior through the vent. Indeed, the blister vent could actually be under water and gases would bubble up and into the atmosphere but no water would enter through the valve.

Continuing onward and upward through membrane 50, passage 42, within body 14, makes an approximately 90° turn and exits through the side of body 14.

Rather than the complex multi-sectional housing of the prior art, the present housing is fused into a single, sealed housing.

More specifically, the inner portion of bottom surface 60 of housing 14 is molded unitarily with shaft 12. Upper portion 62 of housing 14 is molded with lip edge 64 indented to receive bottom surface 60 and with a lip edge 66 to receive and secure membrane 50. The two portions are hermetically fused together to form housing 14 and resulting vent 10.

Normally, roofs are coated with hot tar and this surface, while it may be walked upon, maintains a small degree of resiliency. When vent 10 is secured to the roof by turning, the junction of the housing and the roof results in a leak proof seal. In actual operation, however, to ensure a tight seal, a small amount of adhesive material, tar or roof repair composition is applied to the bottom surface of body 14. As vent 10 is rotated downwardly, that compound fills the gap, squeezes out around the base of the housing, seals and secures vent 10 to the roof surface. The length and shape of threads 20 ensures a firm, secure grip on layers 30 and insulation layer 32.

Only one vent hole 24 is illustrated, but it will be understood that a plurality of vent holes may be drilled or molded into shaft 12 to intercept central bore 40.

In operation, one who is delegated to roof maintenance carries several blister vents in his pocket or tool chest. When he comes upon a blister, he pierces it with a sharply pointed tool, such as an ice pick or an awl, applies a small amount of adhesive material and inserts a blister vent. Because of the hexagonal shape of the housing, the vent is easily gripped by the user and screwed into the opening. For final tightening, the user may apply rotary motion by use of a coin, a screw driver, or any similar object compatible with the slit in the housing.

It will be understood that this invention is not to be limited to the precise form disclosed in the preferred embodiment or by the terms of the above description, but may be modified without departing from the scope of the appended claims.

I claim:

1. In combination with a roof surface having a multiplicity of layers thereon, a housing having a passageway therein and containing a gas permeable and liquid impermeable membrane positioned within and intercepting said passageway, an open ended hollow shaft extending downwardly from said housing, the hollow portion thereof in communication with said passageway, said hollow shaft further including thin generally ribbon-like threads on the outer surface thereof, the pitch of which approximates the thickness of each layer of said multiplicity of layers, said shaft having a vent opening extending laterally through one of said threads from and in communication with said hollow portion, thereby allowing gases to be vented from said roof structure through said hollow shaft and said housing without permitting liquid to enter into said roofing surface through said passageway in said hollow shaft and said housing.

2. The combination of claim 1 wherein said vent hole is defined by a cut-away portion of said last mentioned thread.

* * * * *